US007064496B2

(12) United States Patent
Edamura

(10) Patent No.: US 7,064,496 B2
(45) Date of Patent: Jun. 20, 2006

(54) STATE DETECTION DEVICE

(75) Inventor: Koji Edamura, Tama (JP)

(73) Assignee: Mitsumi Electric Co., Ltd., Tokyo (JP)

( * ) Notice: Subject to any disclaimer, the term of this patent is extended or adjusted under 35 U.S.C. 154(b) by 0 days.

(21) Appl. No.: 10/999,414

(22) Filed: Nov. 30, 2004

(65) Prior Publication Data

US 2005/0168174 A1 Aug. 4, 2005

(30) Foreign Application Priority Data

Jan. 30, 2004 (JP) ..... 2004-024427

(51) Int. Cl.
*H05B 37/02* (2006.01)

(52) U.S. Cl. ..... 315/224; 315/291; 315/307; 315/276; 315/312; 315/324; 315/325

(58) Field of Classification Search ..... 315/224, 315/291, 307, 239, 227 R, 276, 312, 324, 315/325, 225, 158, 119, 149
See application file for complete search history.

(56) References Cited

U.S. PATENT DOCUMENTS 5,548,189 A * 8/1996 Williams ..... 315/224
6,114,814 A * 9/2000 Shannon et al. ..... 315/219
6,486,612 B1 * 11/2002 Fujimura et al. ..... 315/225
6,909,238 B1 * 6/2005 Huang ..... 315/119
6,979,959 B1 * 12/2005 Henry ..... 315/291
2004/0004596 A1 * 1/2004 Kang et al. ..... 345/102
2005/0029967 A1 * 2/2005 Chen et al. ..... 315/291
2005/0264239 A1 * 12/2005 Endo ..... 315/224

FOREIGN PATENT DOCUMENTS

JP 07045379 2/1995
JP 11067474 3/1999
JP 2000021586 1/2000

* cited by examiner

*Primary Examiner*—Haissa Philogene
(74) *Attorney, Agent, or Firm*—Ladas & Parry LLP

(57) ABSTRACT

A state detection device is disclosed that is for detecting driving states of plural loads which are connected with each other in parallel and are driven by a driving unit. The state detection device includes a voltage detection unit for detecting voltages applied to the loads; a combined voltage generation unit for generating a combined voltage equivalent to a combination of the detected voltages; and a state detection unit for detecting driving states of the loads based on a magnitude of the combined voltage and magnitudes of the voltages applied to the loads.

4 Claims, 4 Drawing Sheets

FIG.2

| | V1 | V2 | V3 | A | B | C | D | Q1 |
|---|---|---|---|---|---|---|---|---|
| 4 CCFL ON | V11 | V11 | 0.75V11 | H | H | H | H | ON |
| 1 CCFL OFF | 3/2×V11 | 4/3×V11 | 4/3×0.75V11 | H | L | H | H | OFF |
| 2 CCFL OF 1 PAIR OFF | 0 | 2×V11 | 2×0.75V11 | H | L | H | H | OFF |
| 4 CCFL OFF | 0 | 0 | 0 | L | UN-DETERMINED | UN-DETERMINED | H | OFF |
| 1 CCFL OF EACH PAIR OFF | V11 | V11 | 0.75V11 | H | H | H | L | OFF |

STATE DETECTION DEVICE

BACKGROUND OF THE INVENTION

1. Field of the Invention

The present invention relates to a state detection device, particularly, a state detection device that detects driving states of a plurality of loads connected with each other in parallel and driven by a driving current supplied by a driving unit.

2. Description of the Related Art

In recent years and continuing, liquid crystal displays are attracting attention as display devices of computers or televisions, because they can be made thin and have low power consumption. The liquid crystal displays include transmission type liquid crystal displays and reflection type liquid crystal displays, and in each of the transmission type liquid crystal displays, a back light is provided to supply light from the back side of the screen of the liquid crystal display.

In many cases, electric discharge tubes, such as CCFLs (Cold Cathode Fluorescent Lamps), are used in the back light. The number of the CCFLs is increased depending on the size of the liquid crystal display. For example, usually, four CCFLs are used for a 17-inch liquid crystal display.

FIG. 4 is a schematic view showing a system having four CCFLs.

As illustrated in FIG. 4, there are four CCFLs 101-1 through 101-4. In order to simplify electrical connections, the CCFLs 101-1 through 101-4 are divided into a pair of CCFLs 101-1 and 101-2, and a pair of CCFLs 101-3 and 101-4, and the two pairs are respectively connected to three-pin connectors CN1 and CN2.

The connector CN1 includes terminals T11, T12, T13, and the connector CN2 includes terminals T21, T22, T23.

As illustrated in FIG. 4, the high voltage end of the CCFL 101-1 is connected to the terminal T11, the high voltage end of the CCFL 101-2 is connected to the terminal T12, and both the low voltage end of the CCFL 101-1 and the low voltage end of the CCFL 101-2 are connected to the terminal T13. The high voltage end of the CCFL 101-3 is connected to the terminal T21, the high voltage end of the CCFL 101-4 is connected to the terminal T22, and both the low voltage end of the CCFL 101-3 and the low voltage end of the CCFL 101-4 are connected to the terminal T23.

The terminals T11, T12 and the terminals T21, T22 are connected to the same connection point through condensers C, and are further connected to a driving circuit or others. The terminals T13 and T23 are grounded through resistances.

Usually, the CCFL, which is an electric discharge tube, is turned on by a high voltage, and after being turned on, the ON state of the CCFL is maintained by a low voltage. If the turn-on operation fails, the CCFL has to be lit on once again. For this reason, in the related art, it is necessary to detect the ON state of the electric discharge tube. In the related art, a circuit is used to detect the voltages on the two ends of the electric discharge tube to determine the ON state thereof. This technique is disclosed in, for example, Japanese Laid Open Patent Application No. 7-45379, Japanese Laid Open Patent Application No. 11-67474, and Japanese Laid Open Patent Application No. 2000-21586.

However, the circuit of the related art can just detect the ON or OFF state of one electric discharge tube.

In the case of plural electric discharge tubes, such as a back light of a liquid crystal display, even when only one of the electric discharge tubes is turned on, the detection circuit of the related art determines that the back light is in an ON state. But, in the back light of a large liquid crystal display using plural electric discharge tubes, if one of the electric discharge tubes fails to be turned on, the other electric discharge tubes are turned on, the brightness of the liquid crystal display screen ends up being non-uniform, and the liquid crystal display cannot operate appropriately. For this reason, it is required that a detection circuit be able to reliably detect failure of lighting on even one electric discharge tube.

SUMMARY OF THE INVENTION

Accordingly, a general object of the present invention is to solve one or more problems in the related art.

A more specific object of the present invention is to provide a state detection device that is able to detect driving states of a plurality of loads easily and reliably.

According to the present invention, there is provided a state detection device for detecting driving states of a plurality of loads which loads are connected with each other in parallel, the loads being driven by a driving current supplied from a driving unit. The state detection device includes a voltage detection unit configured to detect voltages applied to the loads; a combined voltage generation unit configured to generate a combined voltage equivalent to a combination of the voltages detected by the voltage detection unit; and a state detection unit configured to detect driving states of the loads based on a magnitude of the combined voltage and magnitudes of the voltages applied to the loads.

Preferably, the state detection device further has a second state detection unit configured to detect the driving states of the loads based on the combined voltage generated by the combined voltage generation unit.

Preferably, the state detection device further has a third state detection unit that detects the driving current supplied from a driving unit to the loads, and detects the driving states of the loads based on the driving current.

Preferably, the loads are electric discharge tubes.

According to the present invention, the state detection device detects voltages applied to the loads, and generates a combined voltage of detected voltages applied to the loads, and detects driving states of the loads based on a magnitude of the combined voltage and magnitudes of the voltages applied to the loads. Therefore, when one or more loads are failed to be driven, the state detection device can find this failure. Therefore, the state detection device can easily and reliably detect driving states of the loads, such as an ON or OFF state of an electric discharge tube.

These and other objects, features, and advantages of the present invention will become more apparent from the following detailed description of the preferred embodiments given with reference to the accompanying drawings.

BRIEF DESCRIPTION OF THE DRAWINGS

FIG. 2 is a table for explaining the operation of the back light system 1 according to the first embodiment;

DESCRIPTION OF THE EMBODIMENTS

Below, embodiments of the present invention are explained with reference to the accompanying drawings.

First Embodiment

Figure 1:
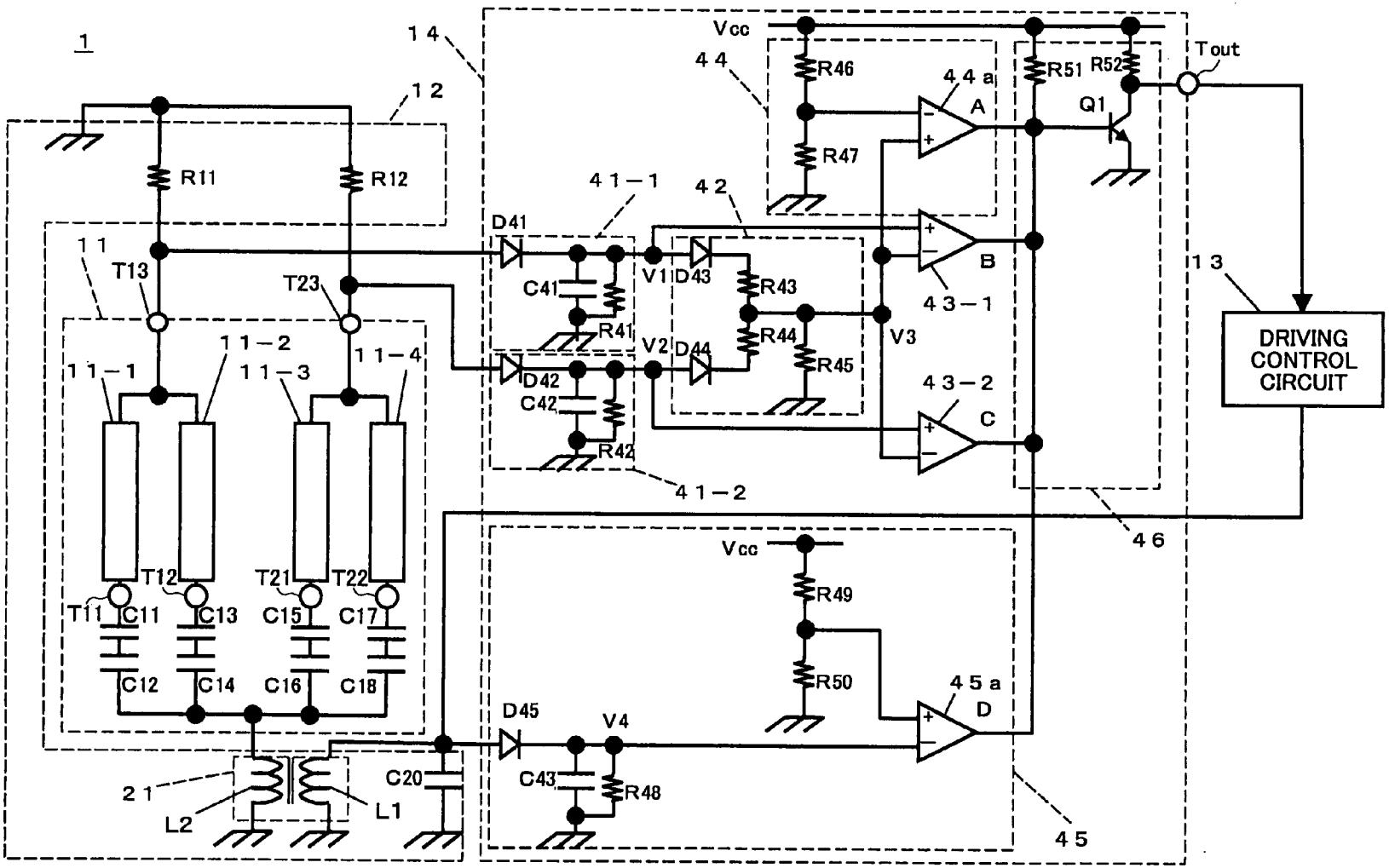
FIG. 1 is a circuit diagram of a detection circuit according to a first embodiment of the present invention.

FIG. 1 is a circuit diagram of a detection circuit according to a first embodiment of the present invention.

In the present embodiment, descriptions are made with a back light in a liquid crystal display as an example.

FIG. 1 illustrates a back light system 1 includes a lamp section 11, a driving circuit 12, a driving control circuit 13, and a state detection device 14.

The lamp section 11 includes four CCFLs 11*a* through 11*d*, and condensers C11 through C18. The four CCFLs 11-1 through 11-4 are connected with each other in parallel. The low voltage end of the CCFL 11-1 and the low voltage end of the CCFL 11-2 are connected together, and can be connected to a terminal T13. In addition, the low voltage end of the CCFL 11-3 and the low voltage end of the CCFL 11-4 are connected together, and can be connected to a terminal T23. The terminal T13 is grounded through a resistance R11, and the terminal T23 is grounded through a resistance R12.

The high voltage end of the CCFL 11-1 is connected to a terminal T11, and the terminal T11 is connected to the driving circuit 12 through condensers C11 and C12.

The high voltage end of the CCFL 11-2 is connected to a terminal T12, and the terminal T12 is connected to the driving circuit 12 through condensers C13 and C14.

The high voltage end of the CCFL 11-3 is connected to a terminal T21, and the terminal T21 is connected to the driving circuit 12 through condensers C15 and C16.

The high voltage end of the CCFL 11-4 is connected to a terminal T22, and the terminal T22 is connected to the driving circuit 12 through condensers C17 and C18.

The driving circuit 12 supplies driving currents to the four CCFLs 11-1 through 11-4, and thereby, the lamp section 11 is driven by a driving voltage from the driving circuit 12 and is lit on.

The driving circuit 12 includes a condenser C20, a transformer 21, and resistances R11 and R12. The driving circuit 12 responds to a driving signal from the driving control circuit 13, resonates together with the CCFLs 11-1 through 11-4, and applies a driving voltage to the CCFLs 11-1 through 11-4 from a second coil L2 of the transformer 21.

The driving control circuit 13 supplies the driving signal to the driving circuit 12 in response to a lamp ON signal from the outside.

The state detection device 14 includes detection units 41-1 and 41-2, an intermediate voltage generation unit 42, comparators 43-1 and 43-2, an all-OFF state detection unit 44, a driving current detection unit 45, and an output unit 46.

The detection unit 41-1 includes a diode D41, a condenser C41, and a resistance R41. The detection unit 41-1 is connected to the terminal T13, and generates a detection voltage V1 which is obtained by rectifying and smoothing the voltage at the terminal T13. The detection voltage V1, which is rectified and smoothed in the detection unit 41-1, is input to a non-inverted input terminal of the comparator 43-1 and the intermediate voltage generation unit 42.

The detection unit 41-2 includes a diode D42, a condenser C42, and a resistance R42. The detection unit 41-2 is connected to the terminal T23, and generates a detection voltage V2 which is obtained by rectifying and smoothing the voltage at the terminal T23. The detection voltage V2, which is rectified and smoothed in the detection unit 41-2, is input to a non-inverted input terminal of the comparator 43-2 and the intermediate voltage generation unit 42.

The intermediate voltage generation unit 42 includes diodes D43, D44, and resistances R43, R44, R45, and generates an intermediate voltage V3 which is obtained by dividing the detection voltage V1 from the detection unit 41-1 and the detection voltage V2 from the detection unit 41-2 with the resistances R43, R44, R45. The intermediate voltage V3 generated by the intermediate voltage generation unit 42 is input to inverted input terminals of the comparators 43-1, 43-2 and the all-OFF state detection unit 44.

The comparator 43-1 compares the detection voltage V1 from the detection unit 41-1 with the intermediate voltage V3 generated by the intermediate voltage generation unit 42. The comparator 43-1 sets an output signal B to be at a high level when the detection voltage V1 is higher than the intermediate voltage V3, and outputs the output signal B to be at a low level when the detection voltage V1 is lower than the intermediate voltage V3. The output signal B from the comparator 43-1 is supplied to the output unit 46.

The comparator 43-2 compares the detection voltage V2 from the detection unit 41-2 with the intermediate voltage V3 generated by the intermediate voltage generation unit 42. The comparator 43-2 sets an output signal C thereof to be at a high level when the detection voltage V2 is higher than the intermediate voltage V3, and sets the output signal C to be at a low level when the detection voltage V2 is lower than the intermediate voltage V3. The output signal C from the comparator 43-2 is supplied to the output unit 46.

The all-OFF state detection unit 44 includes resistances R46, R47, and a comparator 44*a*, and detects a state in which all of the CCFLs 11-1 through 11-4 are OFF. A power voltage Vcc is divided by the resistances R46, R47 and a reference voltage Vref1 is generated. The reference voltage Vref1 divided by the resistances R46, R47 is input to an inverted input terminal of the comparators 44*a*.

The comparator 44*a* compares the reference voltage Vref1 divided by the resistances R46, R47 with the intermediate voltage V3 generated by the intermediate voltage generation unit 42. The comparator 44*a* sets an output signal A to be at a high level when the intermediate voltage V3 is higher than the reference voltage Vref1, and sets the output signal A to be at a low level when the intermediate voltage V3 is lower than the reference voltage Vref1.

The output signal A from the all-OFF state detection unit 44 is supplied to the output unit 46.

The driving current detection unit 45 supplies the driving current to the lamp section 11, and detects an OFF state of the CCFL 11-1 or 11-2, which form a pair of CCFLs, and the CCFL 11-3 or 11-4, which form another pair of CCFLS. The driving current detection unit 45 includes a diode D45, a condenser C43, resistances R48 through R50, and a comparator 45*a*. The diode D45, the condenser C43, and the resistance R48 rectify and smooth a voltage applied to a first coil L1 of the transformer 21 of the driving circuit 13, and generate a detection voltage V4. The detection voltage V4 is input to an inverted input terminal of the comparator 45*a*.

The power voltage Vcc is divided by the resistances R49 and R50, and a reference voltage Vref2 is generated. The reference voltage Vref2 generated by the resistances R49 and R50 is input to a non-inverted input terminal of the comparator 45*a*.

Here, the resistance values of the resistances R49 and R50 are appropriately chosen so that the reference voltage Vref2 generated with the resistances R49 and R50 is higher than the detection voltage V4 when the CCFLs 11-1 through 11-4 are turned ON.

The comparator 45*a* compares the reference voltage Vref2 with the detection voltage V4. The comparator 45*a* sets an output signal D to be at a high level when the detection voltage V4 is lower than the reference voltage Vref2, and sets the output signal D to be at a low level when the detection voltage V4 is higher than the reference voltage Vref2.

The output signal D from the driving current detection unit 45 is supplied to the output unit 46.

The output unit 46 includes resistances R51, R52, and an NPN transistor Q1. The output signals A, B, C, and D from the comparators 43-1, 43-2, the all-OFF state detection unit 44, and the driving current detection unit 45 are input to the base of the NPN transistor Q1. The power voltage Vcc is applied to the collector of the NPN transistor Q1. A state output terminal Tout is connected to a connection point of the collector of the NPN transistor Q1 and the resistance R52. The emitter of the NPN transistor Q1 is grounded. The state output terminal Tout is connected to the driving circuit 13.

When one of the CCFLs 11-1 through 11-4 is turned OFF, and any of the output signals A, B, C, and D from the comparators 43-1, 43-2, the all-OFF state detection unit 44, and the driving current detection unit 45, respectively, is at the low level, the NPN transistor Q1 is switched off and outputs a high level from the state output terminal Tout.

When all of the CCFLs 11-1 through 11-4 are turned ON, and the output signals A, B, C, and D from the comparators 43*a*, 43*b*, the all-OFF state detection unit 44, and the driving current detection unit 45 are all at the high level, the NPN transistor Q1 is switched on and outputs a low level from the state output terminal Tout.

When the state output terminal Tout is at the low level, the driving circuit 13 determines that all of the CCFLs 11-1 through 11-4 are lit ON, and supplies the driving current to the driving circuit 12 to maintain the ON state of the lamp section 11.

When the state output terminal Tout is at the high level, the driving circuit 13 determines that at least one of the CCFLs 11-1 through 11-4 fails to light on, hence is in the OFF state, and stops supplying the driving current to the driving circuit 12, that is, stops driving the lamp section 11.

Next, a description is made of an operation of the back light system 1 according to the first embodiment.

FIG. 2 is a table for explaining the operation of the back light system 1 according to the first embodiment.

The driving control circuit 13 supplies the driving signal to the driving circuit 12 in response to a lamp ON signal from the outside to the driving control circuit 13.

The driving circuit 12 resonates with the CCFLs 11-1 through 11-4, and thereby, the driving current flows through the CCFLs 11-1 through 11-4 to light them on.

State 1

If the CCFLs 11-1 through 11-4 are all light on, the detection voltages V1, V2 from the detection units 41-1 and 41-2 turn to a certain voltage V11. Here, if R43, R44, and R45 satisfy R43=R44=R45/3, the intermediate voltage V3 satisfies: V3=0.75×V11.

Accordingly, the output signals B and C from the comparators 43-1 and 43-2 are both at the high level. Because the intermediate voltage V3 is higher than the reference voltage Vref1, the output signal A is at the high level. Because the detection voltage V4 is lower than the reference voltage Vref2, the output signal D is at the high level. Hence, because the CCFLs 11-1 through 11-4 are all light on, the output signals A through D are all at the high level. Thus, the transistor Q1 is switched on, and the state output terminal Tout is at the low level.

Because the state output terminal Tout is at the low level, the driving circuit 13 determines that all of the CCFLs 11-1 through 11-4 are lit ON, and supplies the driving current to the driving circuit 12 to maintain the ON state of the lamp section 11.

State 2

If one of the CCFLs 11-1 through 11-4 is light off, the detection voltage V1 from the detection unit 41-1 satisfies: V1=2/3×V11, and the detection voltage V2 from the detection unit 41-2 satisfies: V2=4/3×V11.

Hence, the intermediate voltage V3 satisfies: V3=(4/3)×0.75×V11.

Accordingly, the output signal B from the comparator 43-1 is at the low level because the detection voltage V1 is lower than the intermediate voltage V3.

Since the output signal B from the comparator 43-1 is at the low level, the transistor Q1 is switched off, and the state output terminal Tout is at the high level. Since the state output terminal Tout is at the high level, the driving circuit 13 determines that at least one of the CCFLs 11-1 through 11-4 fails to light on, hence is in the OFF state, and stops supplying the driving current to the driving circuit 12 to switch off the lamp section 11.

State 3

Assume the CCFLs 11-1 and 11-2 form a pair, and the CCFLs 11-3 and 11-4 form another pair.

If either of the two pairs of CCFLs is light off, for example, both the CCFL 11-1 and CCFL 11-2 are light off, the detection voltage V1 from the detection unit 41-1 equals zero, V1=0, and the detection voltage V2 from the detection unit 41*b* satisfies: V2=2×V11.

Hence, the intermediate voltage V3 satisfies: V3=2×0.75×V11.

Accordingly, the output signal B from the comparator 43-1 is at the low level because the detection voltage V1 is lower than the intermediate voltage V3.

Since the output signal B from the comparator 43*a* is at the low level, the transistor Q1 is switched off, and the state output terminal Tout is at the high level. Since the state output terminal Tout is at the high level, the driving circuit 13 determines that at least one of the CCFLs 11-1 through 11-4 fails to light on, hence is in the OFF state, and stops supplying the driving current to the driving circuit 12 to switch off the lamp section 11.

State 4

If the CCFL 11-1 through CCFL 11-4 are all light off, the detection voltage V1 from the detection unit 41-1 and the detection voltage V2 from the detection unit 41-2 equal zero, V1=0, V2=0. Hence, the intermediate voltage V3 equals zero, too. As a result, the outputs from the comparators 43-1 and 43-2 are not stable.

On the other hand, the output of the all-OFF state detection unit 44 is at the low level, because the intermediate voltage V3 is compared with the reference voltage Vref1, and the intermediate voltage V3 equals zero.

Since the output signal from the all-OFF state detection unit 44 is at the low level, the transistor Q1 is switched off, and the state output terminal Tout is at the high level. Since the state output terminal Tout is at the high level, the driving circuit 13 determines that at least one of the CCFLs 11-1 through 11-4 fails to light on, hence is in the OFF state, and stops supplying the driving current to the driving circuit 12 to switch off the lamp section 11.

State 5

Again, assume the CCFLs 11-1 and 11-2 form a pair, and the CCFLs 11-3 and 11-4 form another pair. The detection unit 41-1 detects the driving current of the pair of the CCFLs 11-1 and 11-2, and the detection unit 41-2 detects the driving current of the pair of the CCFLs 11-3 and 11-4.

If one CCFL in each of the two pairs is light off, for example, the CCFL 11-1 and CCFL 11-3 are light off, the detection voltages V1, V2 from the detection units 41-1 and 41-2 equal to the voltage V11. Here, if R43, R44, and R45 satisfy R43=R44=R45/3, the intermediate voltage V3 satisfies: V3=0.75×V11.

Accordingly, the output signals B and C from the comparators 43-1 and 43-2 are both at the high level. Because the intermediate voltage V3 is higher than the reference voltage Vref1, the output signal A is at the high level. Hence, a usual driving current is supplied to the lamp section 11. However, if the driving current flowing in one CCFL equals I under usual conditions, because only two CCFLs are light on in the present case, the driving current flowing in the CCFLs equals 2I. Hence, the voltage on the condenser at the high voltage side turns to be twice the usual voltage, and the voltage on the first coil L1 of the transformer 21 also increases. As a result, the voltage V4 is higher than the reference voltage Vref2, and the output signal D from the driving current detection unit 45 is at the low level.

Since the output signal D from the driving current detection unit 45 is at the low level, the transistor Q1 is switched off, and the state output terminal Tout is at the high level. Since the state output terminal Tout is at the high level, the driving circuit 13 determines that at least one of the CCFLs 11-1 through 11-4 fails to light on, hence is in the OFF state, and stops supplying the driving current to the driving circuit 12 to switch off the lamp section 11.

In this way, it is possible to detect the ON or OFF states of any combination of the CCFLs 11-1 through 11-4, and reliably identify the state of the CCFLs 11-1 through 11-4.

Second Embodiment

Figure 3:
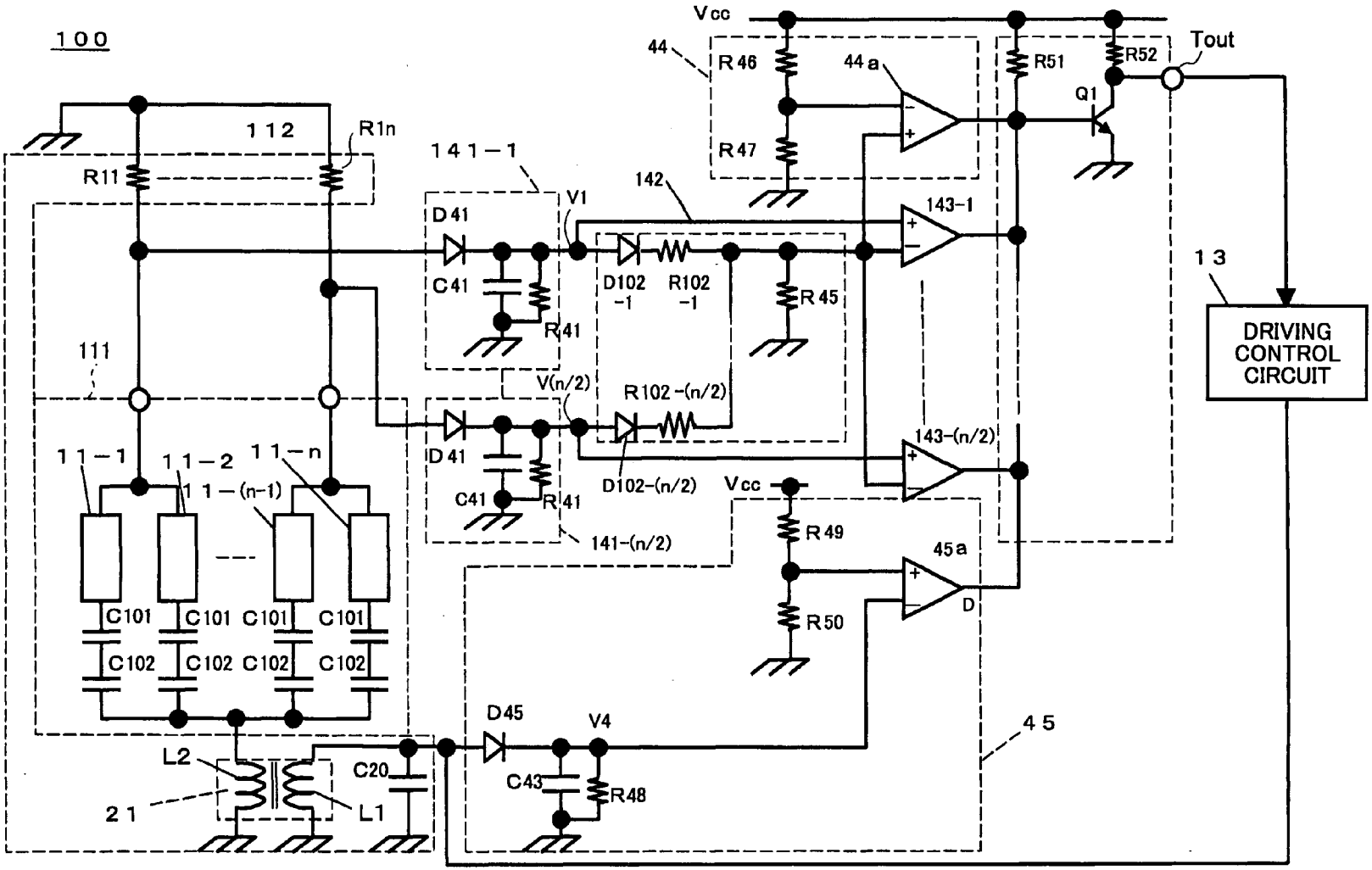
FIG. 3 is a circuit diagram of a detection circuit according to a second embodiment of the present invention.
Figure 4:
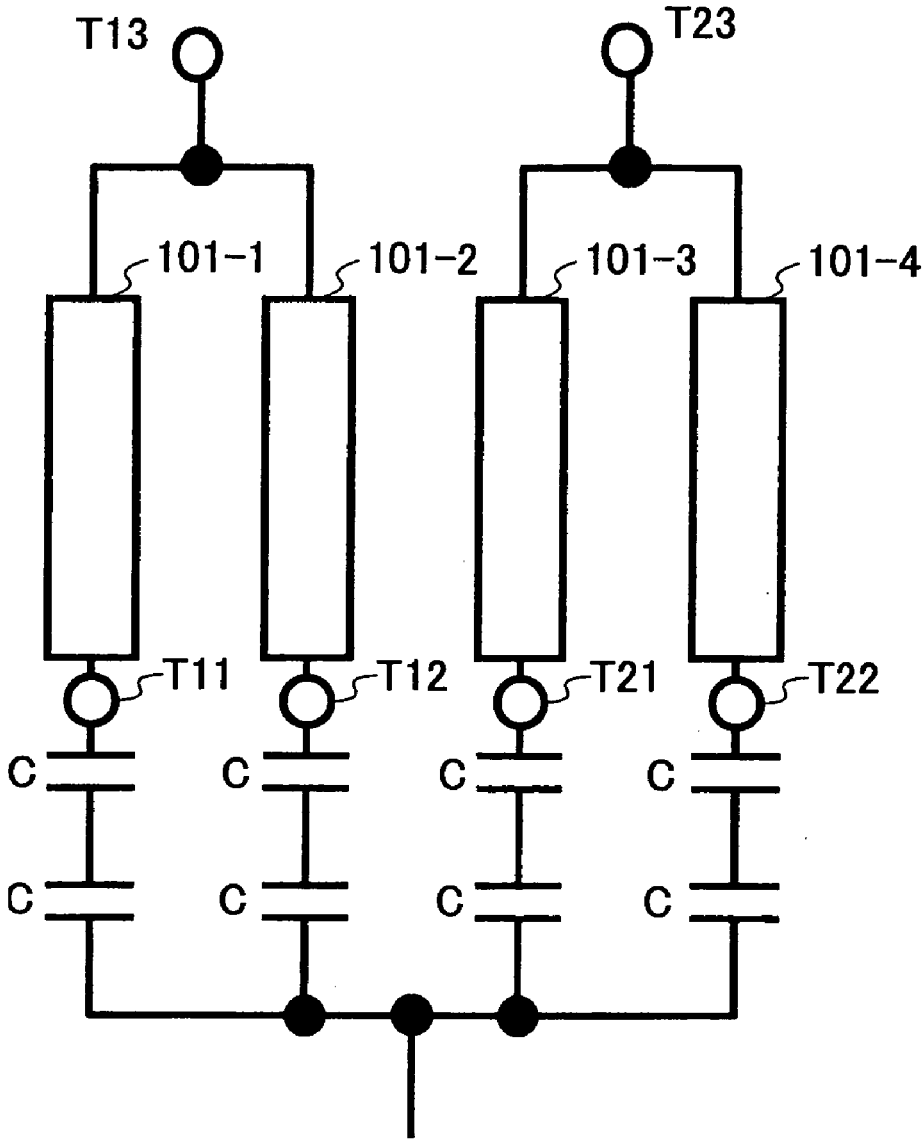
FIG.4 PRIOR ART
FIG. 4 is a schematic view showing a back light system having four CCFLs.

FIG. 3 is a circuit diagram of a detection circuit according to a second embodiment of the present invention. In FIG. 3, the same reference numbers are used for the same element as those shown in FIG. 1, and the overlapping descriptions are omitted.

In a back light system 100 according to the present embodiment, a lamp section 111 includes a number of n CCFLs 11-1 through 11-n.

Among the n CCFLs 11-1 through 11-n, every two of them form a pair, and detection units 141-1 through 141-(n/2) detect voltage at connection points with resistances R11 through R1n of a driving circuit 112. The detection units 141-1 through 141-(n/2) have the same structure as that of the detection unit 41. The voltages V1 through V(n/2) detected by the detection units 141-1 through 141-(n/2) are input to an intermediate voltage generation unit 142 and inverted input terminals of comparators 143-1 through 143-(n/2).

The intermediate voltage generation unit 142 includes diodes D102-1 through D102-(n/2), and resistances R102-1 through R102-(n/2) and R45, and generates an intermediate voltage V3.

Comparators 143-1 through 143-(n/2) compare the detection voltages V1 through V(n/2) with the intermediate voltage V3; their output signals are at a high level if corresponding detection voltages V1 through V(n/2) are higher than the intermediate voltage V3; and the output signals B are at a low level if the corresponding detection voltages V1 through V(n/2) are lower than the intermediate voltage V3.

The output signals from the comparators 143-1 through 143-(n/2) are supplied to the output unit 46.

According to the present embodiment, it is possible to detect ON or OFF states of any combination of a number of n CCFLs 11-1 through 11-n, and reliably identify the state of the n CCFLs 11-1 through 11-n.

While the present invention has been described with reference to specific embodiments chosen for purpose of illustration, it should be apparent that the invention is not limited to these embodiments, but numerous modifications could be made thereto by those skilled in the art without departing from the basic concept and scope of the invention.

This patent application is based on Japanese Priority Patent Application No. 2004-024427 filed on Jan. 30, 2004, the entire contents of which are hereby incorporated by reference.

What is claimed is:

1. A state detection device for detecting driving states of a plurality of loads that are connected with each other in parallel, said loads being driven by a driving current supplied from a driving unit, said state detection device comprising:

a voltage detection unit configured to detect voltages applied to the loads;

a combined voltage generation unit configured to generate a combined voltage equivalent to a combination of the voltages detected by the voltage detection unit; and a state detection unit configured to detect the driving states of the loads based on a magnitude of the combined voltage and magnitudes of the voltages applied to the loads.

2. The state detection device as claimed in claim 1, further comprising:

a second state detection unit configured to detect the driving states of the loads based on the combined voltage generated by the combined voltage generation unit.

3. The state detection device as claimed in claim 1, further comprising:

a third state detection unit that detects the driving current supplied from a driving unit to the loads, and detects the driving states of the loads based on the driving current.

4. The state detection device as claimed in claim 1, wherein the loads are electric discharge tubes.

* * * * *